US010105025B2

(12) United States Patent
Lagimoniere, Jr.

(10) Patent No.: US 10,105,025 B2
(45) Date of Patent: Oct. 23, 2018

(54) DUST MITIGATION DEVICE FOR MANUAL SAW

(71) Applicant: Ernest Eugene Lagimoniere, Jr., Huntingtown, MD (US)

(72) Inventor: Ernest Eugene Lagimoniere, Jr., Huntingtown, MD (US)

( * ) Notice: Subject to any disclaimer, the term of this patent is extended or adjusted under 35 U.S.C. 154(b) by 302 days.

(21) Appl. No.: 15/157,482

(22) Filed: May 18, 2016

(65) Prior Publication Data

US 2016/0338559 A1 Nov. 24, 2016

Related U.S. Application Data

(60) Provisional application No. 62/179,814, filed on May 19, 2015.

(51) Int. Cl.
*A47L 7/00* (2006.01)

(52) U.S. Cl.
CPC ..... *A47L 7/0095* (2013.01)

(58) Field of Classification Search
CPC . B23Q 11/02; B23Q 11/0046; B23Q 11/0071; B23B 2270/30; A47L 7/0095
USPC ..... 408/67; 409/137; 144/252.1; 83/100, 83/168; 15/347, 339, 399; 30/124, 133; 175/209
See application file for complete search history.

(56) References Cited

U.S. PATENT DOCUMENTS 4,214,317 A * 7/1980 Kelly, Sr. ..... A61F 9/02 175/211
4,251,171 A * 2/1981 Brett ..... B23Q 11/0053 125/20
5,292,210 A * 3/1994 Nowick ..... B23B 51/0426 408/204
5,588,213 A * 12/1996 Swanberg ..... B23D 59/006 30/124
5,653,561 A * 8/1997 May ..... B23Q 11/0046 408/67
5,983,445 A * 11/1999 Baker ..... B08B 15/04 144/252.1
7,175,371 B2 * 2/2007 Vidal ..... B23Q 11/0064 408/1 R
2007/0264092 A1 * 11/2007 Kesten ..... B23Q 11/0046 408/67
2012/0084986 A1 * 4/2012 Klawitter ..... B23D 59/006 30/516

* cited by examiner

*Primary Examiner* — Sarah B McPartlin

(57) ABSTRACT

A device for effectively controlling and collecting debris created when cutting or trimming a material. This device includes a hollow generally prismatic and rigid transparent body, an evacuation penetration in the body for the removal of debris, an interface opening in the body where the device is intended to contact a cutting substrate, a tool access penetration in the body where the blade of a cutting tool, such as a jab saw, can be inserted through the body and into the cutting substrate as well as edge protection around the tool access penetration to prevent damage to the device body if contact with the cutting tool is made when in operation. Debris created during the operation of the cutting tool is contained within the device body and evacuated via vacuum through the evacuation penetration.

16 Claims, 5 Drawing Sheets

DUST MITIGATION DEVICE FOR MANUAL SAW

RELATED APPLICATION

Priority is claimed to Provisional Patent Application Ser. 62/179,814, filed May 19, 2015.

BACKGROUND OF THE INVENTION

This invention relates to the containment, collection and removal of debris created when using cutting and trimming tools. In particular this invention relates to the containment and collection of dust created when using manually operated cutting tools, such as saws, when cutting or trimming materials, such as drywall, that create a significant amount of dust.

Many homeowners and builders have encountered the need to cut materials that create large amounts of dust in both unfinished and finished interior spaces of homes or commercial buildings. Particularly in finished spaces, even small cutting and trimming jobs can result in large messes that are often difficult and time consuming to clean. Specialized hand operated motorized cutting equipment and vacuum attachments already exist for many cutting applications but these tools are typically expensive and require substantial effort to configure. These tools allow the user to vacuum away the dust created when the cutting tool is in operation. However, these motorized tools and their corresponding dust collection and evacuation equipment are typically not practical for use by the average homeowner due both to cost and complexity. For those with access to professional equipment the effort required to assemble and configure these tools are substantial when there is only a small cutting job to be performed.

Both the professional construction worker and the average homeowner typically already own and make use of ubiquitous manual saws for cutting and trimming projects. However, currently no devices exist that work in conjunction with a manual saw to mitigate and contain dust creation. Alternatives such as attempting to hold the end of a vacuum hose near the cutting area while cutting are awkward at best and only slightly lessen the resulting mess, especially if cutting in an overhead area. This invention, when used in conjunction with a standard shop vacuum, provides the capability to easily and effectively mitigate dust created when cutting materials, such as drywall, using generic manual saws without the need for expensive and specialized equipment.

SUMMERY OF THE INVENTION

The present invention resides in a device which is designed to contain and collect debris created during the cutting of materials with tools such as manual saws.

The hollow and rigid transparent body of this device is generally prismatic with several openings in the body to allow a tool to be inserted through the body and into the cutting material and to permit the evacuation of debris created during tool operation from the body cavity.

An interface opening forms a rim around a portion of the body that is planar and adapted to make flush contact with a planar cutting substrate. This opening, of substantial size to surround the tool contact point with the cutting substrate when in operation without interfering with the tool operation, will not permit debris to escape between the body and cutting substrate surfaces. It is envisioned in a certain embodiment that the rim formed around the interface opening would be covered with a material to facilitate the sliding of the device over the cutting substrate and prevent marking or scuffing of the cutting substrate.

A tool access penetration on the body, generally opposite and parallel to the interface opening, is adapted to allow the cutting tool to penetrate through the body into the cutting substrate and be effectively operated when the interface opening is aligned and mounted flush on the cutting substrate. The size and shape of the tool access penetration are configured so as to be small enough to minimize the area around the tool where debris could escape while at the same time being large enough to allow the tool to be operated though the penetration with minimal or no inadvertent contact with the body. Additionally, the relative size and orientation of the tool access penetration to the interface opening are such that the cutting tool can be operated into a corner of the cutting substrate without needing to lift the device from the cutting substrate and without having the tool contact the device body.

Tool access edge protection around the rim of the tool access penetration protects the body from contact of the tool with the device body at the rim of the tool access penetration. In one embodiment this protection may consist of the application of an additional material around the rim of the tool access penetration with higher strength and/or lower coefficient of friction. In a preferred embodiment, rollers integrated into the device body near and on opposite sides of the tool access penetration prevent the cutting tool from contacting the body, by engaging the cutting tool teeth and rolling with them as the cutting tool is operated.

An evacuation penetration, generally on a side of the body between and perpendicular to the interface opening and tool access penetration, is adapted to allow the removal of any debris created from the cutting tool that is deposited within the interior of the device body via vacuum. In a preferred embodiment this penetration is adapted to form a hollow cylindrical extension from the body that is sized to mate with standard shop vacuum connection compression fittings. The hollow cylindrical extension would be located on the body in such a way as to facilitate the grasping and manipulation of the device with one hand clasped around the hollow extension.

It is envisioned that the operator of the device, holding the device in one hand via the evacuation penetration hollow circular extension, would then operate the cutting tool after inserting the tool through the tool access penetration with the other hand. The body, made out of a rigid and transparent material, would allow the operator to follow and scribed guidelines identifying the location of the desired cut that were applied to the surface.

These and other features will become more apparent in the detailed description, in conjunction with the drawings, which further illustrate the principles of this invention.

BRIEF DESCRIPTION OF THE DRAWINGS

The accompanying drawings illustrate the invention. In such drawings.

DETAILED DESCRIPTION OF PREFERRED EMBODIMENTS

As shown in the accompanying drawings for purposes of illustration the present invention resides in a device which is particularly designed for capturing and evacuating debris produced by cutting tools such as manual saws. The body of this device is referred to by reference number 1 in FIGS. 1-7. As will be further discussed this device will allow an operator to effectively collect and capture dust created during the cutting of a substrate, such as drywall, while operating a manual saw in a conventional manner.

Figure 1:
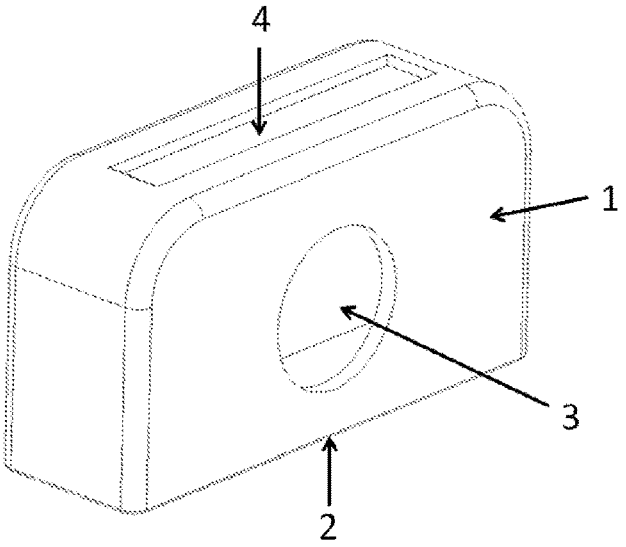
FIG. 1 is a top perspective view of a debris collecting device embodying the present invention.
Figure 2:
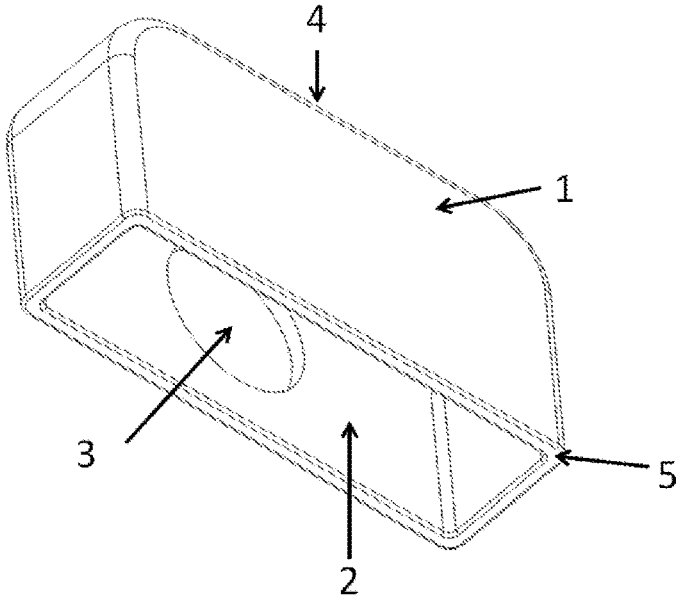
FIG. 2 is a bottom perspective view of the same embodiment identified in FIG. 1.

Referring to FIGS. 1-2 one can see a demonstration of the most basic embodiment of this invention. The generally prismatic hollow and transparent body 1 has three penetrations. FIG. 1 identifies the location of the tool access penetration 4 in the top of the device body 1. This penetration is generally rectangular and elongated to allow cutting tools such as manual saws, whose blades are typically much deeper than they are wide, to easily pass through tool access penetration 4. The tool access penetration 4 is also opposite and generally parallel to the interface opening 2 located at the bottom of the device body, which can be seen more clearly in FIG. 2, such that a cutting tool can be inserted completely through the device body by passing first through the tool access penetration 4 and then the interface opening 2. The interface opening 2 is relatively large when compared to the tool access penetration 4 and is formed in such a way as to be planar so that it can rest flush against a cutting surface, preventing any debris from escaping at the interface between the device and the cutting substrate. Additionally, FIG. 2 identifies the location of non-marking protection 5 around the rim of the interface opening 2. This protection consists of a material, either coated on or appropriately bonded to the rim of the interface opening, to prevent the device from marking the cutting substrate and facilitate the movement of the device over the cutting substrate. The evacuation penetration 3 is an opening in the side of the body generally perpendicular to both the tool access penetration and interface opening where debris created during the operation of the cutting tool can be evacuated from the device. The evacuation penetration 3 is generally located proximally to the interface opening 2 to ensure that debris can immediately be evacuated as it is created by the cutting tool at the boundary of the interface opening.

Figure 3:
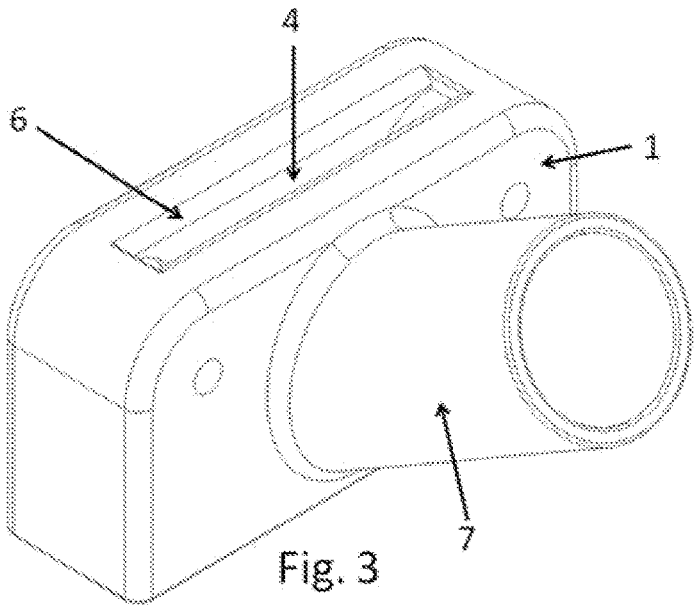
FIG. 3 is an isometric view of a more preferred embodiment of the device illustrating the general location of the tool access penetration edge protection and hollow extension encompassing the evacuation penetration.

FIG. 3 demonstrates a more preferred embodiment of the device that includes several additional features. The first of which is a hollow extension 7 encompassing the evacuation penetration that extends outward from the device body 1. This generally circular hollow extension 7 has thickness similar to the body and is constructed of a similar material. The hollow extension is formed with proportions that allow a common shop vacuum hose attachment to be mated to it either from within or without the hollow extension 7. Additionally the hollow extension may be oriented in a way so as to angle away from the plane of the interface opening as it extends away from the device body to make it easier for an operator to grasp the hollow extension and thus maneuver the device with one hand. Additionally FIG. 3 identifies the location of tool edge protection materials that may either be coated on to or appropriately bonded around the rim of the tool access penetration 4. The protective material used to provide the edge protection would be stronger with potentially a lower coefficient of friction than the material of the device body to offer extra protection if the cutting tool were to contact the device body at the location of the tool access penetration during operation of the cutting tool.

Figure 4:
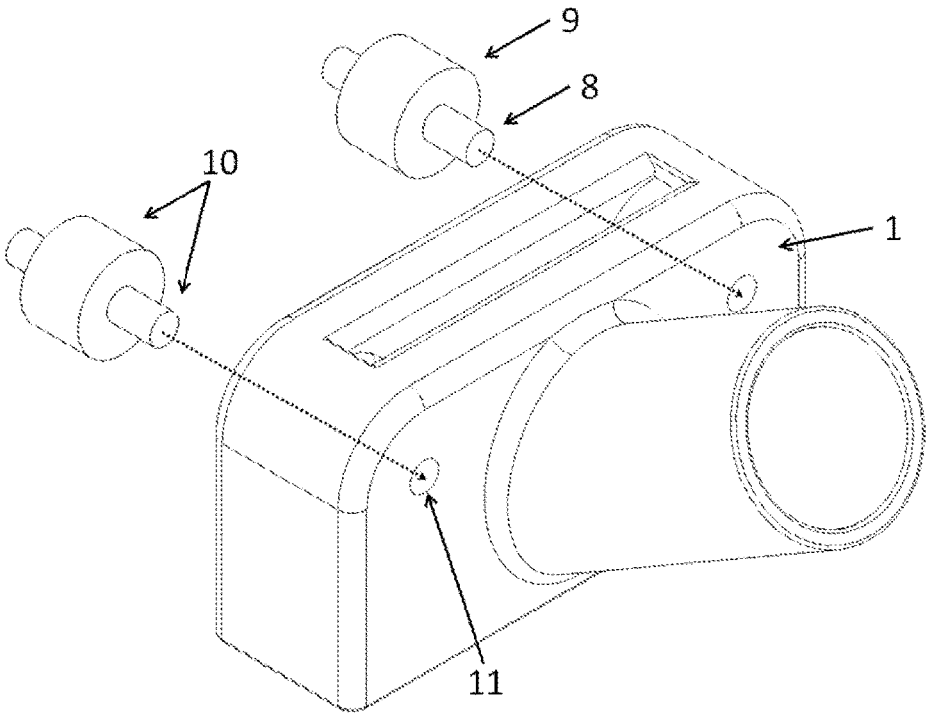
FIG. 4 is an isometric view of a further preferred embodiment identifying the construction of roller assemblies and illustrating their integration in the device body via holes in the device body.

The most preferred embodiment, seen in FIG. 4, of this invention would also integrate rollers 10 into the device body 1 on opposite sides of the tool access penetration 2. These rollers may be formed from the elements of an axle 8 and roller body 9 into a roller assembly 10 where the axle simply fits through a hole, slightly larger than the diameter of the axle, in the middle of the roller along its longitudinal axis. An additional embodiment of the invention would include a roller body 9 that is narrowed in center, forming a generally hourglass shape, so as to facilitate directing the tool 13, when engaged with the roller body 9, towards the center of the tool access penetration 4 and thus minimize likelihood that tool 13 would contact device body 1 at edges of the tool access penetration 4. An additional embodiment of the invention would also incorporate bearings between the axle 8 and the roller body 9 to ensure the roller body experiences minimum rolling resistance when engaged by the cutting tool. These roller assemblies 10 would then be integrated in the device body 1 by positioning and aligning the roller bodies 9 inside the device body 1 and then inserting the axles 9 through appropriately located holes 11 on opposite sides of the body, as indicated by the dotted arrows. Thus the axle would be supported on both sides where the axle is inserted through holes 11 on opposing sides of the device body 1 and the roller body 9 would be free to rotate around the axle 8 being held in place within the cavity of the device body. These roller bodies 9 would be incorporated in the device body 1 such that the location of the rollers relative the tool access penetration would not allow the operator to be able to make cutting tool contact with the device at the location of the tool access penetration in the primary direction of cutting tool stroke. If the cutting tool were to make contact with the rollers during operation the cutting tool teeth would engage the roller body and the roller body would roll with the teeth for the remainder of the cutting tool stroke. An additional embodiment of the device would incorporate roller assemblies on the lateral edges of the tool access penetration as well.

Figure 5:
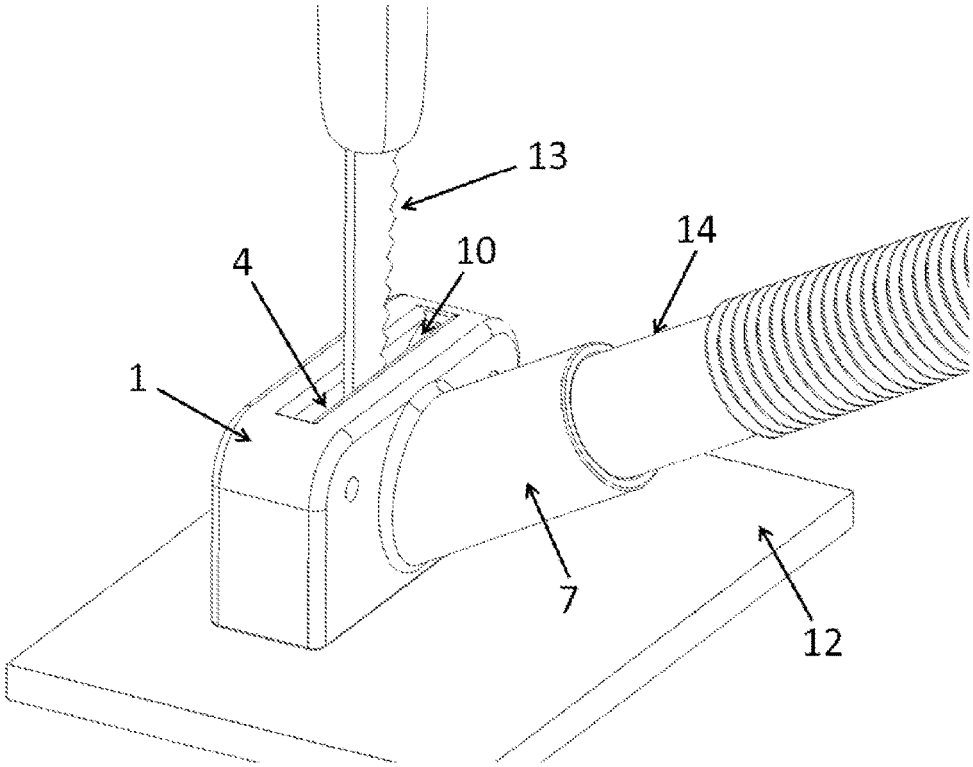
FIG. 5 is an isometric view of the preferred embodiment having a cutting tool inserted through the tool access penetration and into the cutting substrate as well as a vacuum hose inserted into the evacuation penetration hollow extension. This figure also illustrates where the tool access penetration edge protection rollers would engage the cutting tool.
Figure 6:
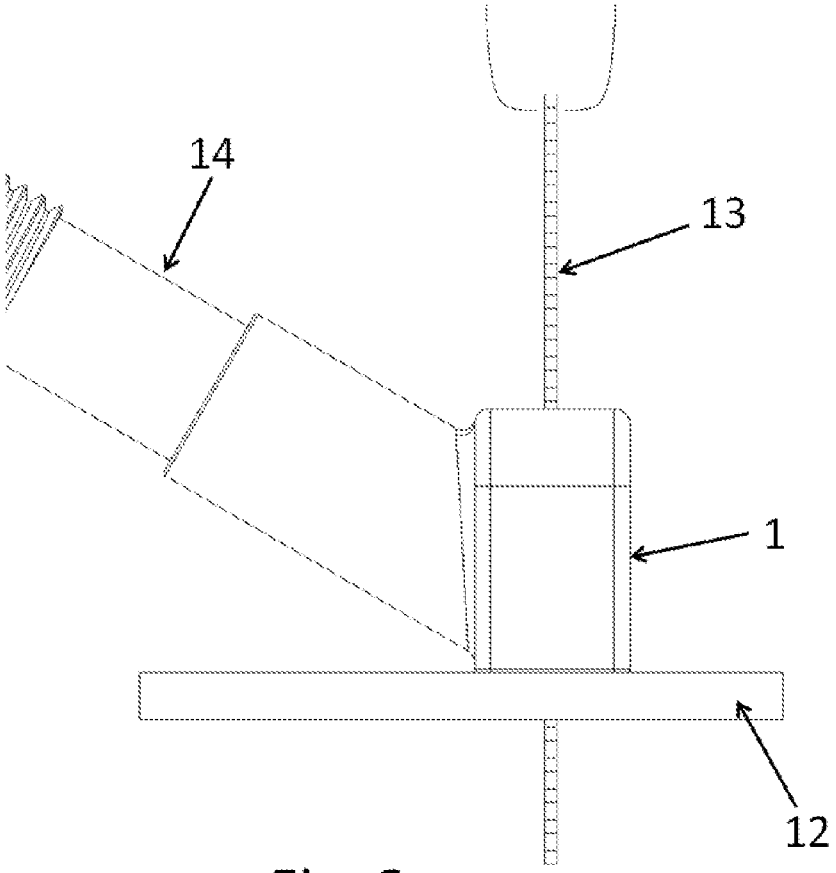
FIG. 6 is a side view of the preferred embodiment having a cutting tool inserted through the tool access penetration into and through the cutting substrate as well as a vacuum hose inserted into the evacuation penetration hollow extension.
Figure 7:
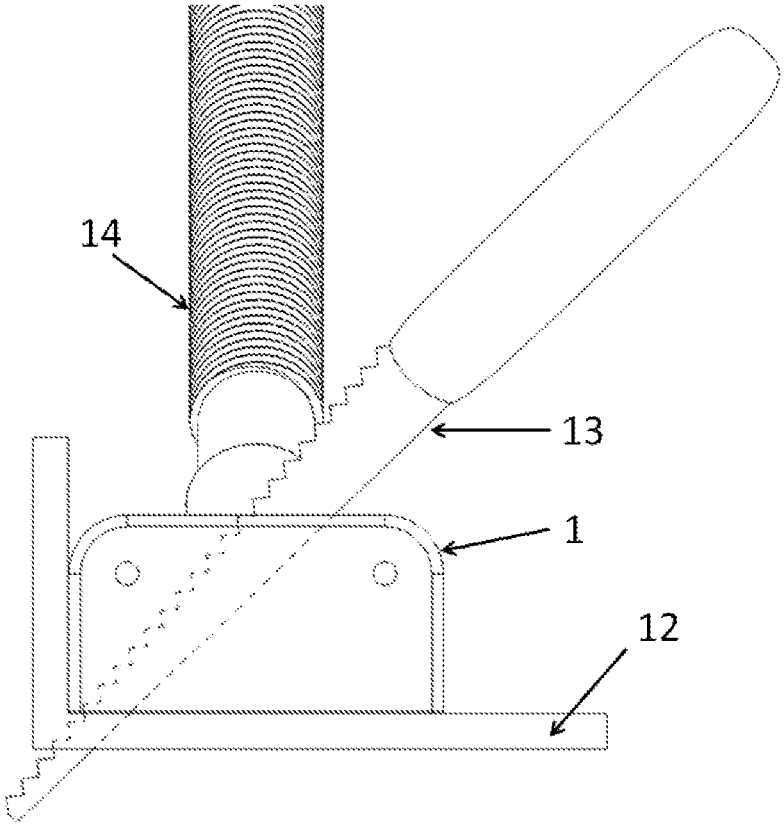
FIG. 7 is a rear view of the preferred embodiment having a cutting tool inserted through the tool access penetration into and through the cutting substrate illustrating that the relative geometry of the tool access penetration and interface opening allows the device to be used to cut all the way into an interior corner of substrate while keeping the interface opening flush on the cutting substrate surface.

The operational configuration of the preferred embodiment of the device can be seen in FIG. 5-7 where a vacuum hose 14 is mated to the device having been inserted into the evacuation penetration hollow extension 7 and a cutting tool 13 is inserted through the tool access penetration 4 and interface opening 2 and then into the cutting substrate 12. The position and orientation of the roller assembly bodies 9 relative to the tool access penetration 4 can be seen in FIG. 5 confirming that the saw blade 13 teeth would engage the roller body prior to making contact with the rim of the tool access penetration 4. The flush contact of the interface opening with the cutting substrate 12 can also be seen such that the only area where debris could unintentionally escape the device, when the device is applied flush to the cutting substrate and the cutting tool is in operation, would be the area around the saw blade 13 but inside the tool access penetration. The shape and size of the tool access penetration 4 is such that this area is made as minimal as possible while still allowing unobstructed operation of the cutting tool when inserted through the device. The operator of the device would operate the saw 13 in a conventional manner grasping the saw handle with their dominant hand while the other hand grasps the device around the evacuation penetration hollow extension at the location indicate by the reference number 7. Because the body 1 is transparent the operator will easily be able to follow any scribed cutting guides during operation. FIG. 6 clearly demonstrates the manner in which the cutting tool 13 transits the device, passing first through the tool access penetration on the top of the device then through the interface opening at the bottom of the device then into and through the cutting substrate 12.

A further feature of the preferred embodiment relates to the relative geometry of the device body, tool access penetration and interface opening which is demonstrated in FIG. 7. There may be occasions where the operator of this device wishes to make a cut all the way into an interior corner of substrate, such as would be the case when wanting to cut a piece of drywall all the way into an interior corner of a wall. For these occasions it would be desirable to keep the interface opening of the device flush to the cutting substrate during the entire cutting operation. In FIG. 7 it can be seen that the device body 1 is positioned fully into the interior corner of the cutting substrate 12. Furthermore it can be seen that the cutting tool 13 can be oriented through the tool access penetration and interface opening in a way that allows a cut to be made all the way into the vertex of the corner.

Although several embodiments have been described in detail for purposes of illustration, various modifications may be made without departing from the scope and spirit of the invention. Accordingly this invention is not to be limited, except as by the following claims.

What is claimed is:

1. A device capable of containing and evacuating debris created during the process of using a cutting or abrasion tool on a substrate, the device being comprised of:

a hollow body;

an interface opening on said body forming a planar rim configured to encompass a tool at a location of said tool contact with a substrate;

an evacuation penetration in said body located on a region of the body near the rim of the interface opening and configured to permit the evacuation of debris from the body;

a tool access penetration in said body located on a region of the body distal to the rim of the interface opening and configured to permit tool access through the body;

tool access penetration edge protection consisting of a plurality of rollers and configured to engage the tool during operation to prevent the tool from being able to make contact with rim of the tool access penetration;

whereby the body is configured to contain debris created by the tool when in contact with the substrate and channel the debris towards the evacuation penetration such that the debris can be evacuated by a vacuum.

2. The device of claim 1, wherein the body is rigid.

3. The device of claim 1, wherein the body is transparent or translucent.

4. The device of claim 1, wherein the body is generally shaped as a prism.

5. The device of claim 1, wherein the evacuation penetration is circular.

6. The device of claim 1, wherein the body also comprises a hollow extension encompassing the evacuation penetration that extends in a direction generally away from the body.

7. The device of claim 6, wherein the hollow extension is a hollow cylinder.

8. The device of claim 6, wherein the hollow extension is configured to mate with a vacuum attachment fitting by insertion of the vacuum attachment fitting within the hollow extension.

9. The device of claim 6, wherein the hollow extension is configured to mate with a vacuum attachment fitting by insertion of the vacuum attachment fitting over the hollow extension.

10. The device of claim 1, where the tool access penetration is generally parallel with the interface opening.

11. The device of claim 1, wherein the tool access penetration is generally rectangular.

12. The device of claim 1, wherein the rollers are integrated into the body and positioned along the sides of the tool access penetration with axes of rotation parallel to respective tool access penetration edges.

13. The device of claim 1, wherein the rollers are comprised of a hollow cylindrical roller body and a cylindrical roller axle whose diameter is less than an inner diameter of the roller body and whose width is greater than a width of the roller body.

14. The device of claim 1, wherein the rollers are narrowed in the center forming a generally hourglass shape and configured to direct the tool towards the center of the roller if contact is made with the tool at any point on the roller during operation.

15. The device of claim 1, wherein roller axles of the rollers are integrated into the body by being inserted through penetrations in the body extending along the rolling axis of the installed rollers.

16. The device of claim 1, wherein rolling bearings are incorporated between roller axles and roller bodies.

* * * * *